US005863585A

United States Patent [19]

Sjöberg

[11] Patent Number: 5,863,585

[45] Date of Patent: Jan. 26, 1999

[54] PACKAGE FOR FOOD PRODUCT AND METHOD FOR EMPTYING THE PACKAGE

[75] Inventor: Elisabeth Sjöberg, Lund, Sweden

[73] Assignee: Nestec S.A., Vevey, Switzerland

[21] Appl. No.: 704,486

[22] Filed: Aug. 22, 1996

[30] Foreign Application Priority Data

Aug. 25, 1995 [EP] European Pat. Off. ..... 95202311

[51] Int. Cl.[6] ..... B65D 81/34; A23L 3/00

[52] U.S. Cl. ..... 426/389; 426/115; 426/394; 426/122; 426/113; 383/47

[58] Field of Search ..... 426/113, 115, 426/122, 389, 394; 383/47

[56] References Cited

U.S. PATENT DOCUMENTS

| | | | |
|---|---|---|---|
| 3,175,752 | 3/1965 | Stabenow et al. | 229/51 |
| 3,615,712 | 10/1971 | Keller et al. . | |
| 4,834,245 | 5/1989 | Ohga et al. | 206/610 |
| 5,041,325 | 8/1991 | Larson et al. | 428/156 |
| 5,366,295 | 11/1994 | Montesissa et al. | 383/201 |

FOREIGN PATENT DOCUMENTS

| | | |
|---|---|---|
| 0478812 | 4/1982 | European Pat. Off. . |
| 0218419 | 4/1987 | European Pat. Off. . |
| 0226835 | 7/1987 | European Pat. Off. . |
| 0406613 | 7/1989 | European Pat. Off. . |
| 0499647 | 8/1992 | European Pat. Off. . |
| 0579030 | 1/1994 | European Pat. Off. . |
| 2190684 | 2/1974 | France . |
| 1440461 | 6/1976 | United Kingdom . |
| 2119756 | 5/1982 | United Kingdom . |
| 87/001050 | 1/1987 | WIPO . |

*Primary Examiner*—Marian C. Knode
*Assistant Examiner*—Brenda G. Brumback
*Attorney, Agent, or Firm*—Pennie & Edmonds

[57] ABSTRACT

The invention relates to a package for food product useful for boil-in-bag or microwave. This package comprises a sealed flexible pouch with a web of oriented material having a slit in the direction of the orientation of the material which is covered by an adhesive membrane. The package is opened and emptied by peeling off the membrane to expose the slit, inverting the package and pulling the edges of the package substantially parallel with the slit to open the slit to facilitate emptying of the contents of the package without spillage and with a reduced risk of burning the fingers of the user.

19 Claims, 2 Drawing Sheets

PACKAGE FOR FOOD PRODUCT AND METHOD FOR EMPTYING THE PACKAGE

TECHNICAL FIELD

The invention relates to a package for food products useful for boil-in-bag or microwave cooking.

BACKGROUND ART

Packages for boil-in-bag cooking are well-known and are the most used for frozen food. The bag may e.g. contain a meal which once prepared has been thawed and cooked within the bag. These packages are inexpensive and comprise a sealed pouch, which has to be opened with scissors when the food is heated. The use of a knife or cutting means such as a knife or scissors is not very convenient. Also known are boil-in-bag packages which are opened by pulling of a tab which tears off a strip from the package. The tearing of the strip often takes place along weakening lines in the packaging material.

Other conventional packages comprise mono-oriented plastic material having V- or U-shaped pre-cuts. Due to the mono-orientation of the material a strip of the material can be torn from the package even though it is not provided with weakening lines.

The requirement of consumers is that a boil-in-bag should be easy to handle, i.e. to open and empty without any danger of burning fingers or of spilling or splashing of the contents of the bag. The above discussed packages do not fulfil these requirements sufficiently. For example, emptying by tilting of a package having a strip opening gives an uneven pouring and soiling of the outer surface of the package, while turning downwards the opening will result in splashing of the content.

SUMMARY OF THE INVENTION

We have devised a package which overcomes the above drawbacks and fulfils the requirements of opening and emptying the bag. According to the invention a package is provided which is emptied by unsealing, inverting and subsequent opening the package. The package is provided with an oriented web having a slit which when the package is inverted faces downwards. In this position, the opening of the package is accomplished by simply removing an adhesive membrane which covers the slit, and then pulling the sides of the package in opposite directions. This will open the slit and the package along the orientation and allow the contents to slide out of the packaging and directly into e.g. a receiving bowl without any spilling or splashing or any risk of burning the fingers.

In this way the opening along the slit and the orientation of the web will provide the same effect as if the pouch had been cut open by a knife. Consequently, the present invention provide an easy handling, opening and emptying of the package without any need for: finding and pulling a small tab or strip, risking burning of the fingers or spilling of the content of the package. A further advantage of the present invention is that the design of the package allows a simple manufacture thereof.

Accordingly, in a first aspect, the present invention provides a package comprising a sealed flexible pouch with a web of oriented material having a slit in the direction of the orientation of the material wherein the slit is covered by an adhesive membrane.

The material preferably has one or alternatively two orientations. This kind of material will resist a tear in directions transverse to the orientation or orientations, but once a tear is initiated in the direction of the orientation, the tear will continue along a straight line in this direction. Consequently, the web is provided with slit or slits along orientations. In an embodiment according to the invention employing material having two orientations web material, the web may be provided with a slit or slits along one orientation or alternatively with a cut in the shape of a cross having arms extending in the directions of the orientations.

The adhesive membrane seals the pouch and prevents premature tearing or spreading of the slit in the web. The adhesive membrane may cover one or more slits positioned along a line in the direction of the mono-orientation. Alternatively, these slits may be covered by a number of adhesive membranes. Due to the mono-orientation of the material, pulling in the pouch on opposite sides of the slit will only result in a prolonging or spreading of the slit in the direction of the orientation.

In order to ease the handling and inverting of the package, the package is preferably welded together substantially parallel with the orientation of the material and on opposite sides of the slit or slits. It is preferred that the package comprises a second web which is welded to the web of oriented material. This creates at least two rims or strips of material which can function as handles. After heating and peeling off the adhesive membrane, by gripping the rims, the package is easily inverted and opened when the rims are pulled in opposite directions. The second web may be of any flexible material which can be welded to the oriented web.

If the package is used in a microwave, the adhesive membrane lifts, due to the increase of pressure inside the pack and therefore ventilates, and thus avoids the risk of exploding.

If the package is used in boiling water, the adhesive membrane stays closed due to different temperature ranges involved and the lower pressure present in the package compared with those of a package heated in a microwave oven.

The adhesive used for the adhesive membrane is a pressure sensitive hot melt adhesive, e.g. the commercial available ECOMELT™ L302. The membrane itself may be made of polymer film e.g. thermoplastic polyester or polypropylene film.

The material of the web is any oriented plastic used for food contact and preferably a mono-oriented polyester or polyamide laminated polyethylene. The pouch may comprise webs of other material sealable to the mono-oriented web. For example webs of polyamide or polyethylene can be used.

In another aspect, the invention relates to a method for emptying a package of food product comprising a sealed flexible pouch with a web of oriented material. This method comprises removing an adhesive membrane covering a slit in the web which is positioned in the direction of the orientation, positioning the package with the slit facing downwards, and pulling in the web transverse to the orientation so that opposite sides of the slit part.

BRIEF DESCRIPTION OF THE DRAWINGS

The present invention will now be further illustrated by way of example only with reference to the accompanying drawings in which.

DESCRIPTION OF THE PREFERRED EMBODIMENTS

Figure 1:
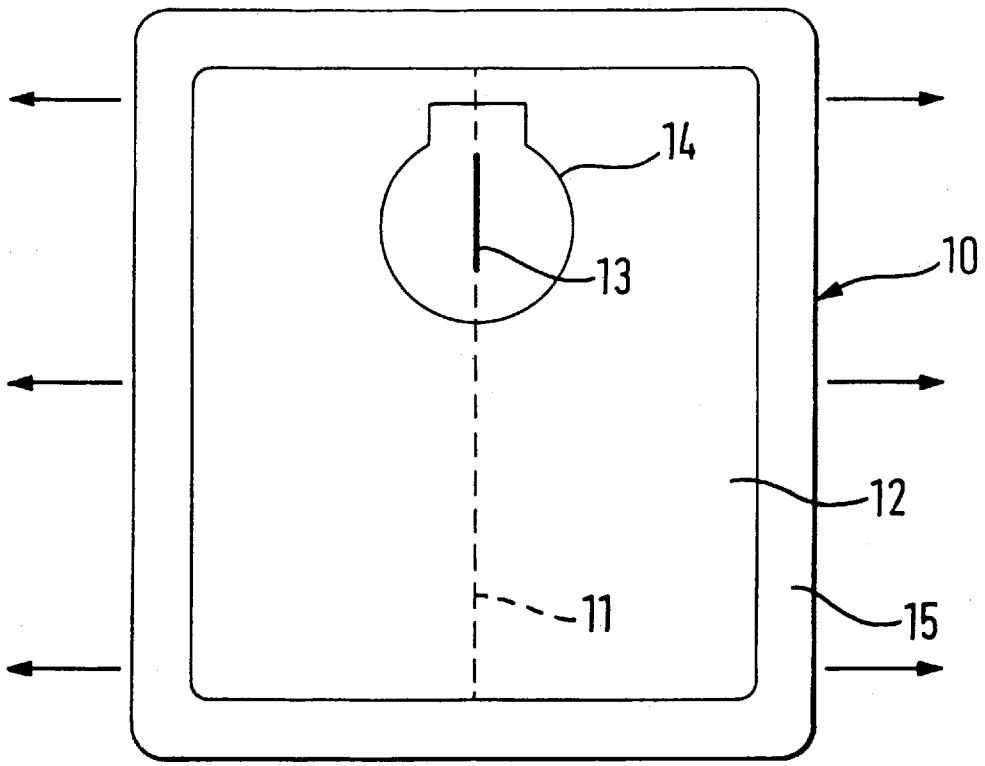
FIG. 1 illustrates a top view of a package when sealed.

FIG. 1 shows a package (10) comprises a sealed flexible pouch with a web (12) of oriented material having a slit (13). The slit (13) is in the direction of the orientation (11) of the material. In order to seal the package the slit (13) is covered by an adhesive membrane (14).

The package (10) is provided with welded edge seams (15) which ease the handling and inverting of the package. The arrows in FIG. 1 indicate the direction the edges are to be pulled in order to open the package (10).

Figure 2:
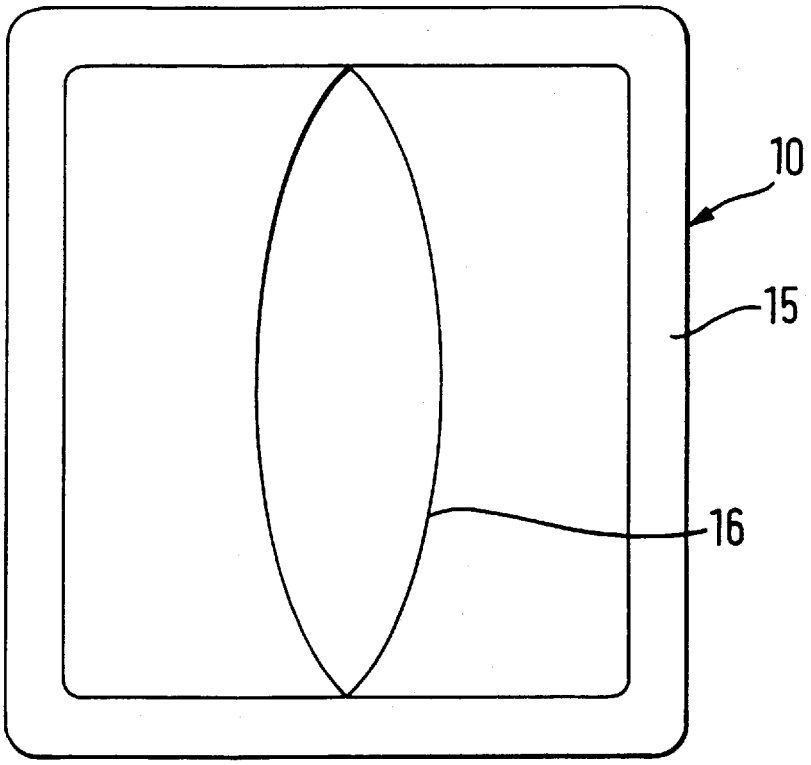
FIG. 2 illustrates a top view of an open package.

The package (10) is opened to the position shown in FIG. 2 by peeling of the adhesive membrane (14), inverting the package and pulled the edges (15) in opposite directions. As a result of these actions the slit (13) will run along the orientation, and an opening (16) is created in the pouch. This opening facilitates emptying of the package without the risk of burning the fingers of the user or without spilling the package contents.

Figure 3:
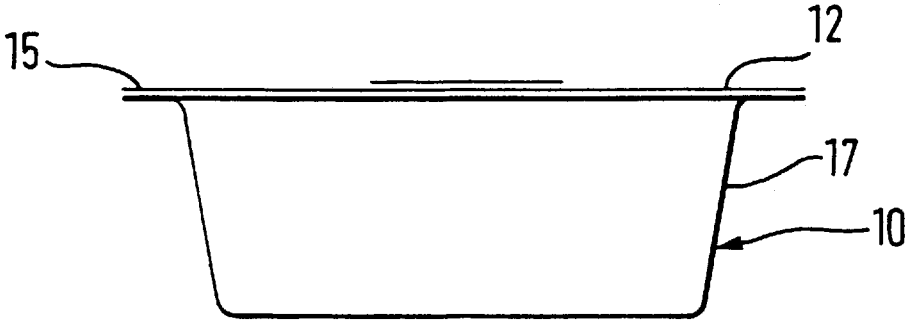
FIG. 3 illustrates a side view of a package.

In FIG. 3 the package (10) comprises a sealed flexible pouch with a top web (12) of oriented material welded to a lower web (17) along the edges so that an edge seam (15) is created.

What is claimed is:

1. Package for food product useful for boil-in-bag or microwave cooking which comprises a sealed flexible pouch of a web of oriented material having a slit in the direction of the orientation of the material which slit is covered by an adhesive membrane, wherein removal of said adhesive membrane does not significantly open said package so that the contents of the package can be removed.

2. Package according to claim 1, wherein the web is a mono-oriented polymeric material.

3. Package according to claim 1, wherein the flexible pouch has a plurality of slits positioned along a line in the direction of the orientation of the material.

4. Package according to claim 1, wherein the web is a mono-oriented plastic film.

5. Package according to claim 4, wherein the mono-oriented plastic film is polyester or polyamide laminated to polyethylene.

6. Package according to claim 1, which further comprises a second web which is welded together with the web of oriented material substantially parallel with the orientation of the material and on opposite sides of the slit.

7. Package according to claim 1 wherein the adhesive membrane comprises a polymer film having first and second sides with an adhesive on at least a portion of one of the sides of the film, the adhesive being present on an area sufficient to surround the slit.

8. Package according to claim 7 wherein the polymer film is of a thermoplastic material, and the adhesive is a pressure sensitive adhesive or a hot melt adhesive.

9. Package according to claim 7 wherein the polymer film of the adhesive membrane is polyester or polypropylene.

10. Package according to claim 3 wherein each slit is covered by an adhesive membrane comprising a polymer film having first and second sides with an adhesive on at least a portion of one of the sides of the film, the adhesive being present on an area of each membrane sufficient to surround the respective slit.

11. Package according to claim 1 wherein a portion of the adhesive membrane does not include adhesive so as to facilitate removal of the membrane.

12. Package according to claim 6 wherein the second web comprises polyamide or polyethylene.

13. A method for emptying a packaged food product of a sealed flexible pouch which comprises:

providing the pouch in the form of a web of oriented material with a slit which is positioned in the direction of the orientation and an adhesive membrane covering the slit, wherein removing said membrane does not significantly open said package so that the contents of the package can be removed; and subsequently applying force to the web transversely to the slit and web orientation so that the slit enlarges to form an opening which facilitates emptying of the food product from the pouch.

14. Method according to claim 13 wherein the membrane is removed after the package food product is cooked.

15. Method according to claim 13 wherein the pouch is inverted after the membrane is removed to empty the food product from the pouch.

16. Method according to claim 13 wherein a plurality of slits are provided in the web to reduce the amount of force needed to form the opening.

17. Method according to claim 13 wherein each slit is covered by an adhesive membrane.

18. Method according to claim 13 wherein the pouch is provided with lateral edges to facilitate applying force to the pouch.

19. Method according to claim 18 wherein the lateral edges are provided by welding a second web to the web of oriented material.

* * * * *